United States Patent [19]

Teodorescu

[11] 4,113,048

[45] Sep. 12, 1978

[54] METHOD OF AND DEVICE FOR ATTENUATING THE NOISE RADIATED BY GAS JETS

[75] Inventor: Constantin Teodorescu, Bucharest, Romania

[73] Assignee: Institutul National Pentru Creatie Stiintifica Si Tehnica - Increst, Bucharest, Romania

[21] Appl. No.: 678,728

[22] Filed: Apr. 21, 1976

[30] Foreign Application Priority Data

Jun. 12, 1975 [RO] Romania ..... 82514

[51] Int. Cl.[2] ..... G10K 11/04; F01N 1/04; F01N 3/04; F04F 5/44

[52] U.S. Cl. ..... 181/220; 98/43 R; 181/222; 181/259; 181/262; 417/198

[58] Field of Search ..... 181/33 HC, 43, 51, 220, 181/259, 262, 222; 98/43, 116; 417/198; 239/265.17

[56] References Cited

U.S. PATENT DOCUMENTS

| | | | |
|---|---|---|---|
| 1,217,615 | 2/1917 | McDowell | 181/43 |
| 2,293,632 | 8/1942 | Sauer | 181/51 |
| 2,831,548 | 4/1958 | Barkelew | 181/43 |
| 3,337,121 | 8/1967 | Coanda | 417/198 |
| 3,794,137 | 2/1974 | Teodorescu et al. | 181/43 |
| 3,815,487 | 6/1974 | Teodorescu et al. | 417/198 |
| 3,899,923 | 8/1975 | Teller | 181/33 HC |

*Primary Examiner*—Stephen J. Tomsky
*Attorney, Agent, or Firm*—Karl F. Ross

[57] ABSTRACT

A method of and a device for attenuating the noise radiated by a free-expansion gas jet throughout the audible-frequency range as well as in the ultrasonic and infrasonic frequency ranges. Concomitantly with the complete and shock-free expansion of the gas into the atmosphere, the acoustic field of the jet is organized by the substantial diminution of the low-frequency tones by causing them to pass from the annular section of the jet to the narrow annular section of the nozzle slot. This is followed by sound-wave diffraction on emergence from the slot in the presence of a baffle, and by a wave reflection towards the sound-absorption lining of the device housing. The final noise results from an intensive ejection of ambient air by the primary gas which, leving the nozzle slot, entrains the air by means of turbulence, the air entering through the annular channels of the case, reaching the outer orifices of the nozzle, and dividing into two flows, namely inside and outside the nozzle.

5 Claims, 5 Drawing Figures

METHOD OF AND DEVICE FOR ATTENUATING THE NOISE RADIATED BY GAS JETS

FIELD OF THE INVENTION

The present invention relates to a method of and a device for attenuating the noise radiated by free-expansion gas jets throughout the audible-frequency range as well as in the ultrasonic and infrasonic-frequency ranges.

BACKGROUND OF THE INVENTION

Methods are known for the attenuation of the noise produced by gas jets by active silencers, or the isolation and reflection of the sound waves to their source or in some other direction by reactive silencers.

The active silencers have the shape of conduits whose inner surfaces are lined with sound-absorbing material; they are built in various versions: with simple chambers, with lamellar or cellular elements and with chambers and screens.

The simple chamber silencer consists of a tube made out of steel plate or of some other material to which the sound-absorbent treatment (sound-absorption layer) is applied only at the walls.

To increase sound-absorbing capacity over a broader frequency range, large-section conduits are divided into a series of subconduits with reduced dimensions by means of sound-absorbing plates parallel to the flow direction and arranged in line with one or both axes of the conduit section (the lamellar or cellular silencer).

The chamber and screen silencer consists of one or several chambers acoustically lined and separated by means of screens arranged normally or obliquely to the path of gas flow. Noise attenuation is achieved by arresting the energy of the sound waves by means of the sound absorbent treatment in order to reflect them to the screens.

The reactive silencer is an acoustic system which allows passage practically without attenuation of sounds of a certain frequency while damping or reflecting towards the source sounds of the remaining frequencies. This acoustic system consists of several chambers successively joined to one another by tubes. Each chamber with its junction constitutes a resonator which damps within a certain frequency range.

It has also been proposed to effect noise attenuation by increasing the surface of the gas stream and ambient air mixture with multisection silencers. These silencers achieve the partial attenuation of the noise by increasing the surface of the gas stream and ambient air mixture while avoiding any turbulence. Under these circumstances quick diminution of the gas velocity is attained along the jet axis and implicitly the attenuation of the low-frequency noises.

There are likewise known nondirectional silencers used especially for the attenuation of the noise generated by the exhausts of internal combustion engines. These silencers have spral or baffle conduits which are provided with orifices or groups of orifices arranged in certain arrays and sometimes accompanied by deflecting cups covering the orifices. Noise attenuation by these silencers is obtained by fragmentation of the gas flow and reflection of the sound waves upstream.

The main disadvantage of these silencers is that they attenuate the noise over a very limited frequency range, namely the high and medium frequency ranges, leaving unattenuated the low and very low frequencies. In order to get a more significant attenuation of the noise, large overall dimensions of the silencer are necessary, making its construction expensive and limiting its utility. At the same time, in lamellar silencers, cellular silencers and silencers with chambers and screens, the high-velocity and high-temperature gases rapidly degrade the inner elements of the silencer, putting it out of use after a relatively short working period.

There is also known a method of attenuating the noise radiated by the gas jets by means of sound wave diffraction passing through networks provided with Coanda flaps, and by the absorption of the sound waves by the sound-absorbent layers on the surfaces of the flaps. These silencers, although strongly attenuating the noise over a broad frequency range, have the disadvantage of large overall dimensions and excessive complexity.

There are also silencers for attenuating the noise produced by gas jets, which have axially symmetrical outer or inner Coanda nozzles. These devices, technologically and structurally complex, have large overall dimensions and great weight but a limited range of gasodynamic parameters for a stable functioning and induce significant counter-pressures along the stream.

SUMMARY OF THE INVENTION

The method according to the invention avoids the abovementioned disadvantages by using, in order to obtain substantial attenuation over the entire range of the audible spectrum, concomitantly with the complete and shock-free expansion of the gas to be discharged into the atmosphere, the reorganization of the acoustic field of the jet by the substantial diminution of the low tones by causing them to pass from the annular section of the jet to the narrow annular section of a nozzle slot, followed by the sound wave diffraction as they leave the slot by a baffle. Wave reflection is then effected toward the sound-absorbent layer of the housing by the flap. Noise attenuation is completed due to an intensive ejection of ambient air by the primary gas which, on leaving the nozzle slot, entrains the ambient air by turbulence, the air entering through annular channels of the housing on reaching the outer orifices of the nozzle being divided into two flows passing respectively inside and outside the nozzle.

The device according to the invention comprises an upright cylindrical housing formed at its lower end with two concentric annular sound-absorbent strata which define a plurality of channels for the secondary air intake.

Inside the housing there is mounted a nozzle fed with primary air by means of a conduit. The nozzle comprises an outer body circumferentially formed at its lower section with a plurality of orifices connected through a series of channels with some other orifices provided in a tapered cylindrical inner body. The upper end of one of these bodies is provided with a baffle which, together with the upper end of the other body, defines a slot, the baffle carrying a flap normal to it.

SPECIFIC DESCRIPTION

Figure 1:
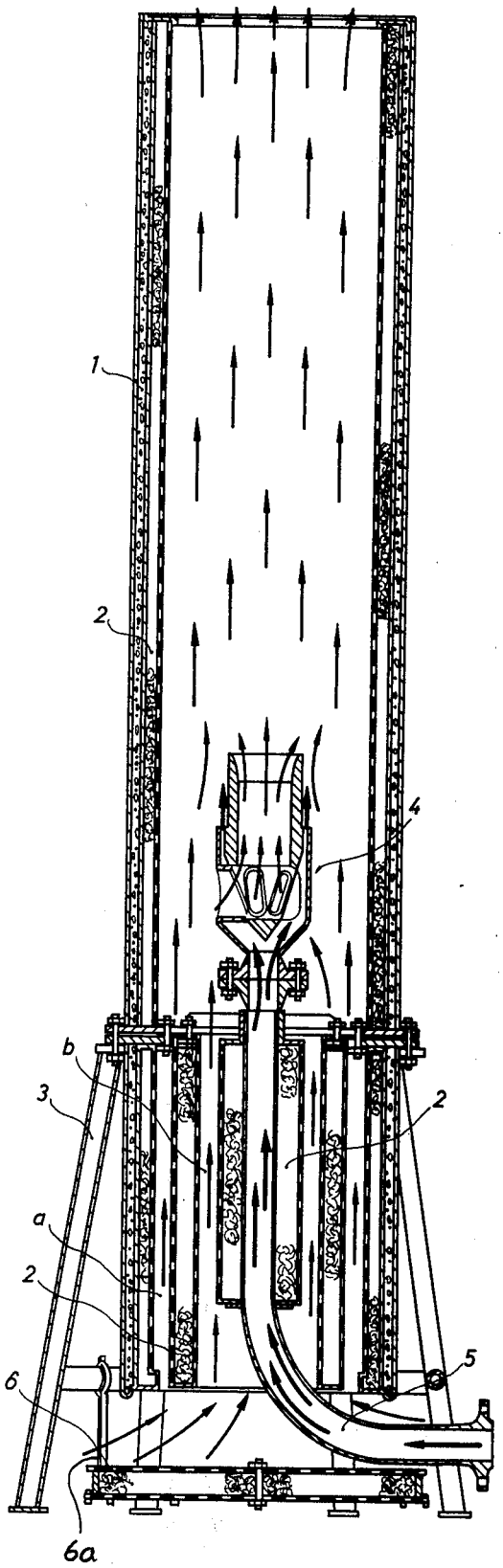
FIG. 1 is a longitudinal (axial) section through the device.

The device shown in the drawing, while representative of any system for discharging a gas jet into the atmosphere with high sound attenuation, is designed particularly for the gaso-dynamic ventilation or air circulation in a closed space. A process and an earlier device for this purpose are described in U.S. Pat. No. 3,815,487 issued to the applicant herein together with others. The device induced the circulation of air in the closed space by causing a primary air or other gas, introduced into the device, to draw secondary air from the surrounding space in through the bottom and discharging the gases through the top.

The device according to the invention consists of an upright cylindrical housing 1, provided all over its inner surface with a layer 2 of sound-absorbing material and supported at its lower end by a stand 3.

Inside the housing 1 there is a nozzle 4 with primary air fed by means of a conduit 5 partially encased in sound-absorbing material 2, at least over the portion of its length which is coaxial with the lower end of the housing 1.

At the lower end of housing 1 the walls are provided with cylindrical annular coaxial and radially spaced tubes of sound-absorbing material 2 which divide the interior of the housing into two axially open annular channels *a* and *b*.

A noise-attenuation screen (see U.S. Pat. No. 3,815,487) is mounted at the lower end of the housing 1 which is formed with an inlet 6*a* for the ambient air.

Figure 2:
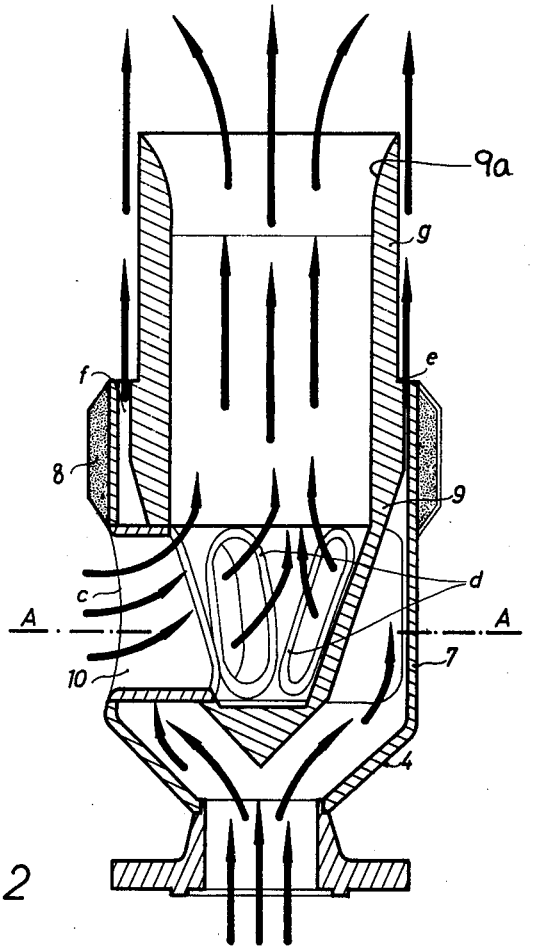
FIG. 2 is a longitudinal section through the nozzle.
Figure 3:
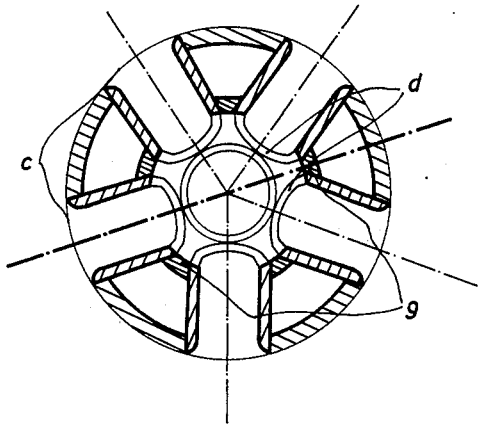
FIG. 3 is a cross-section taken along line A — A of FIG. 2.
Figure 4:
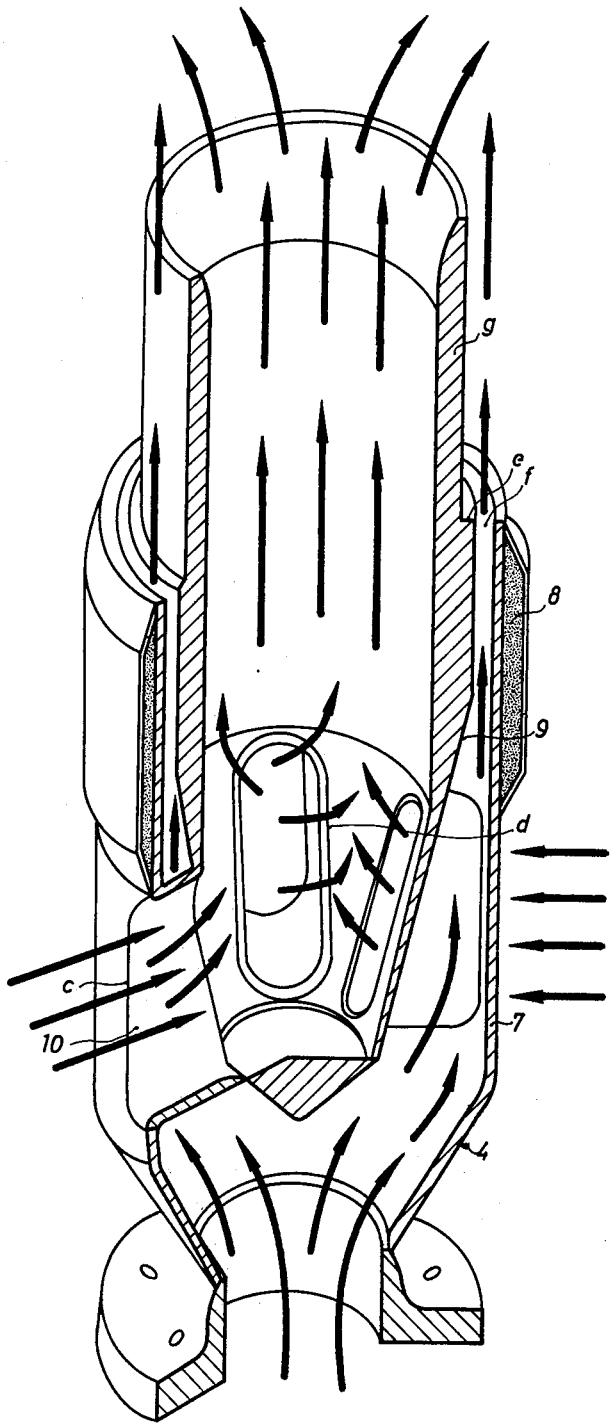
FIG. 4 is a perspective view of the nozzle shown in section.

The nozzle 4 (FIGS. 2 – 4) consists of an outer body 7 having a layer of vibration-damping material 8 at its upper end and a plurality of orifices *c* circumferentially disposed under this stratum. Inside the outer body 7 of the nozzle there is an inner downwardly tapered cylindrical body 9 having at its upper end a diffuser 9*a* and at its lower end a plurality of elliptical orifices *d* disposed opposite the orifices *c* and communicating therewith through respective channels 10.

The inner tapered cylindrical body 9 is provided in the region of the upper end of the outer body 7 with a baffle *e* which, together with the upper end of the outer body, defines a slot *f*, the baffle or shoulder *e* being continued with an extended wall portion *g* disposed normal to the baffle *e*.

The characteristics of the expanded gas jet, leaving the slot *f* of the nozzle 4, vary both as a function of the initial gasodynamic parameters of the gas and as a function of the geometric characteristics of the nozzle. The slot *f*, the baffle or shoulder *e*, the flap *g* and the orifices *c* have values which are interrelated by the following:

$$h = 0.5\, b\, (B/b - 1)$$

$$1 = L(1 + \ln\theta_j)$$

the sum of the cross-sectional area of $$\Sigma_{the\ orifices\ c} = 0.75\ D_{ci}^2$$

where:

$h$ = width of the shoulder *e*

$l$ = length of wall *g*

Figure 5:
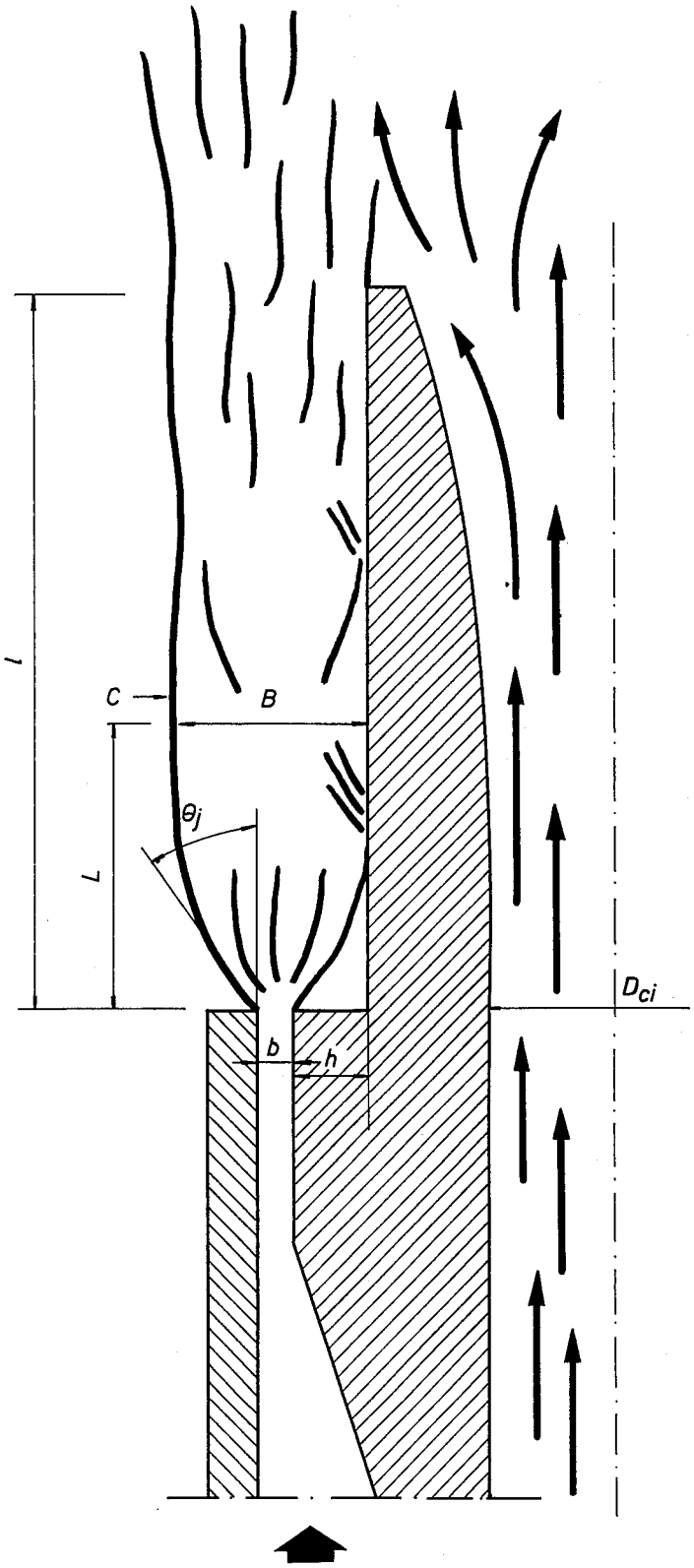
FIG. 5 is a diagram of the primary jet flow on leaving the slot in the presence of the baffle and of the flap.

$b$ = slot width $B$ = maximum width of the underexpanded gas jet (FIG. 5) within the first expansion cell C;

$L$ = distance from the slot plane up to the section at which the jet width is B;

$\theta_j$ = spreading angle (FIG. 5) of the jet emerging from the slot; and $D_{ci}$ = inner diameter of the nozzle inner body.

The device according to the invention functions as follows:

The gas to be discharged into the atmosphere is introduced into the nozzle 4 through the conduit 5, the nozzle configuration being such as to provide complete expansion, without shock, of the gas due to the inner body 9 which is furnished with the baffle *e* and flap *g*. The acoustic field of the jet is modified by substantially diminishing the low tones due to the jet displacement from the annular section to the narrow annular section of the slot *f* followed by the diffraction of the acoustic jet upon leaving the slot at the baffle *e*, as well as by their reflection by the flap *g* towards the sound-absorbent layer 2 of the housing where they are strongly damped.

Inside the housing 1 of the device, and simultaneous with the above-mentioned phenomena there is an intensive process of controlled ejection of the ambient air by the primary gas which, upon leaving the slot *f*, entrains by turbulence the air entering the attenuator through the inlet 6*a*. The secondary air flows along the annular channels *a* and *b* and at the orifices *c* of the nozzle 4, divides into two streams. One of these streams passes through the orifices *c* and *d* and through the central section of the inner body 9, mixes with the primary gas downstream of the diffuser 9*a*; the other stream, advancing parallelly along the outer body 7 of the nozzle 4 up to the slot *f*, mixes with the primary gas along the outer border of the annular jet.

The mixture of the primary gas and ambient air then moves towards the exit section of housing 1 and enters the atmosphere as a jet whose gasodynamic parameters provide perfect noiselessness.

The method and device according to the invention have the following advantages:

they provide strong attenuation of the noise radiated by the underexpanded jet over all of the audible-frequency range as well as over the ultra and infrasonic fields;

they assure the noiseless discharge into the atmosphere of a given gas flow with a large range of initial pressures and temperatures without generating any counterpressures in the upstream conduit; and they allow a series of jet dampers to be designed for high pressures and temperatures having a practically unlimited working life and a cost price which is much lower than that of conventional silencers.

I claim:

1. A device for attenuating noise generated by a jet of expanding gas, comprising:

a nozzle having an axis and discharging a jet of expanding gas, said nozzle including:

an outer cylindrical tubular body having a plurality of first orifices;

an inner cylindrical tubular body coaxial with said outer body and spaced from said outer body to define an annular slot opening in the direction of flow of the gas passing axially between said bodies, said inner body having a first wall portion extending axially beyond said outer body and lying radially inwardly of a second wall of the inner body portion surrounded by said outer body so that said first and second wall portions form an annular shoulder perpendicular to the axis of said nozzle and lying in a plane of the mouth of said slot; and a tapered portion on said inner body formed with a plurality of second orifices in alignment with said first orifices and communicating therewith through respective channels;

a cylindrical tubular housing surrounding said nozzle coaxially and open at both ends, said housing being lined with sound-absorbing material; and a conduit communicating with said outer body for feeding the gas through said annular slot, said gas expanding upon emergence from said slot at said mouth, impinging upon said first wall portion at an angle and spreading at an angle from the outer wall of said slot, and thereafter flowing along said first wall portion and beyond to entrain secondary air through said first orifices, said second orifices and the interior of said inner tubular body.

2. The device defined in claim 1 wherein the length of said first wall portion from said shoulder to the end of said first wall portion equals the product of the distance from said shoulder to the maximum cross section of the expanded jet of gas and the sum of unity with the natural logarithm of the angle formed by the spreading gas at said outer wall of said slot.

3. The device defined in claim 2 wherein the sum of the cross sections of said first orifices of said outer body is substantially three quarters of the square of the internal diameter of said inner body.

4. The device defined in claim 3 wherein said outer body is formed between said shoulder and said first orifices with an external vibration-damping and sound-absorbing layer resistant to high temperature.

5. The device defined in claim 4 wherein said housing is upright and is formed at its lower end with a plurality of coaxial channels separated by sound-absorbing layers, and an inlet for said secondary air.

* * * * *